US009546540B2

(12) United States Patent
Taylor

(10) Patent No.: US 9,546,540 B2
(45) Date of Patent: Jan. 17, 2017

(54) SYSTEM AND METHOD FOR OBSTACLE AVOIDANCE DURING HYDROCARBON OPERATIONS

(71) Applicant: Robert Paul Taylor, St. John's (CA)

(72) Inventor: Robert Paul Taylor, St. John's (CA)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/428,303

(22) PCT Filed: Aug. 30, 2013

(86) PCT No.: PCT/US2013/057621

§ 371 (c)(1),
(2) Date: Mar. 13, 2015

(87) PCT Pub. No.: WO2014/070295

PCT Pub. Date: May 8, 2014

(65) Prior Publication Data

US 2015/0267509 A1 Sep. 24, 2015

Related U.S. Application Data

(60) Provisional application No. 61/720,191, filed on Oct. 30, 2012.

(51) Int. Cl.
*E21B 17/01* (2006.01)
*E21B 43/01* (2006.01)
(Continued)

(52) U.S. Cl.
CPC ..... *E21B 43/01* (2013.01); *E21B 17/01* (2013.01); *E21B 17/012* (2013.01); *E21B 17/05* (2013.01); *E21B 19/00* (2013.01)

(58) Field of Classification Search
CPC ..... E21B 17/015; E21B 19/004; E21B 17/01; E21B 17/012; E21B 19/00; E21B 43/01
(Continued)

(56) References Cited

U.S. PATENT DOCUMENTS 3,648,638 A 3/1972 Blenkarn
4,205,379 A * 5/1980 Fox ..... E21B 41/0014 114/144 B
(Continued)

FOREIGN PATENT DOCUMENTS

DE 2518604 11/1976
EP 666960 6/1999
(Continued)

*Primary Examiner* — Matthew R Buck
(74) *Attorney, Agent, or Firm* — ExxonMobil Upstream Research Company Law Dept.

(57) ABSTRACT

A system and method for obstacle avoidance during hydrocarbon operations utilizing a non-vertical conduit between a vessel and associated subsea equipment. The system comprises a vessel and a conduit connected to the vessel with a first rotatable apparatus which is constructed and arranged to permit the vessel to rotate with respect to the conduit. The system also comprises a second rotatable apparatus connecting the conduit to subsea equipment secured to the seafloor. The second rotatable apparatus is constructed and arranged to permit the conduit to rotate with respect to the subsea equipment.

17 Claims, 4 Drawing Sheets

(51) Int. Cl.
*E21B 17/05* (2006.01)
*E21B 19/00* (2006.01)

(58) Field of Classification Search
USPC ..... 166/353, 355, 367; 405/224.2
See application file for complete search history.

(56) References Cited

U.S. PATENT DOCUMENTS 4,299,262 A * 11/1981 Andrepont ..... B63B 22/025 137/615
4,436,451 A 3/1984 Anderson
4,545,437 A 10/1985 Denison
4,704,050 A 11/1987 Wallace
5,316,509 A 5/1994 Boatman et al.
5,553,976 A * 9/1996 Korsgaard ..... E21B 17/22 138/113
6,109,197 A * 8/2000 Breivik ..... B63B 21/50 114/230.2
6,182,763 B1 * 2/2001 Ingebrigtsen ..... B63B 21/50 166/345
6,209,650 B1 * 4/2001 Ingebrigtsen ..... E21B 33/038 166/345
6,213,215 B1 4/2001 Breivik et al.
6,332,500 B1 * 12/2001 Ellefsen ..... B63B 21/50 114/230.2
6,354,376 B1 * 3/2002 De Baan ..... B63B 21/507 166/302
7,328,741 B2 * 2/2008 Allen ..... E21B 44/00 166/335
7,416,025 B2 8/2008 Bhat et al.
7,789,588 B2 9/2010 De Aquino et al.
7,927,041 B2 4/2011 Bonnemaire et al.
8,398,445 B2 * 3/2013 Kokkinis ..... B63B 21/507 440/57
9,068,398 B2 * 6/2015 Van Petegem ..... B63B 25/28
2002/0157833 A1 10/2002 Wilson
2002/0177375 A1 11/2002 Cottrell et al.
2007/0163481 A1 * 7/2007 Vedeld ..... B63B 27/24 114/230.13
2010/0129161 A1 5/2010 Rodenbusch et al.
2013/0266381 A1 * 10/2013 Pettersen ..... B63B 22/00 405/224.2

FOREIGN PATENT DOCUMENTS

GB 2206144 A * 12/1988 ..... B63B 22/021
NO 306792 11/1999
WO WO 99/66169 12/1999
WO WO 02/076818 A1 10/2002

* cited by examiner

SYSTEM AND METHOD FOR OBSTACLE AVOIDANCE DURING HYDROCARBON OPERATIONS

CROSS-REFERENCE TO RELATED APPLICATION

This application is the National Stage of International Application No. PCT/US2013/057621, filed 30 Aug. 2013, which claims the priority benefit of U.S. Provisional Patent Application 61/720,191, filed 30 Oct. 2012, entitled System and Method for Obstacle Avoidance During Hydrocarbon Operations, each of which is incorporated herein by reference in its entirety.

FIELD OF INVENTION

This invention generally relates to the field of offshore hydrocarbon operations and, more particularly, to a system and method to avoid obstacles, such as arctic ice, during hydrocarbon operations.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Arctic offshore regions are continuing to receive more interest by oil and gas development companies. However, due to the presence of ice floes and icebergs, conducting hydrocarbon extraction related operations, such as, but not limited to, hydrocarbon production and drilling, in offshore arctic locations is difficult.

A conventional offshore drilling system is depicted in FIG. 1. As depicted, a vessel 101 floats in the water 103. The position of both the vessel 101 and a wellhead 105, which is positioned on the seafloor 107, are fixed relative to each other using thrusters or other known techniques. For a drilling vessel, each installation typically includes a single riser 109 used to connect the wellhead 105 to the vessel 101 and pass drilling materials such as, but not limited to, drilling fluid, drill bit and string, casings, and cement. As appreciated by those skilled in the art, wellhead 105 may be equipped with additional hardware, such as, but not limited to, a blowout preventer or a lower marine riser package.

When drilling in offshore arctic locations, it may be required to disconnect from the wellhead 105 due to intrusions of unmanageable ice 111 flowing into the watch circle, or area surrounding the vessel 101. Based on the vertical configuration of the riser 109, the vessel 101 must remain relatively stationary over the wellhead 105 in order to protect the riser 109 and its connection to the wellhead 105. There is some horizontal tolerance 113 in the vessel's position, though it is typically limited by some amount, often less than 5% of the water depth (or riser length), in order to prevent damage to the riser 109. Because of the limited horizontal tolerance of the vertical riser, ice floes (particularly in shallow water) pose a significant risk to riser integrity. Therefore, small icebergs or other dangerous ice features that may cause damage to the rig or well must be detected early enough to disconnect the riser or allow for the ice to otherwise be mitigated. In addition to impending ice 111, the vessel 101 may drift off of its fixed position due to a variety of conditions, such as, but not limited to, wind, waves, current or drive off due to thruster malfunction.

Though drift-off and drive-off are rare, such conditions are not acceptable as an operational norm as they require emergency measures to disconnect the riser 109. It is therefore desirable to limit the number of riser disconnections.

In some Arctic environments, such as those with significant icebergs or pack ice, potential ice features exceeding any practical resistance may frequently occur. It is difficult to accurately forecast multi-day ice drift patterns. As a result, the state of the art strategy is to either schedule drilling when there is no threat of significant ice or to actively manage the ice through iceberg towing or lead icebreakers in pack ice. However, there are potential locations, such as, but not limited to, those near the toe of a glacier or an ice shelf, where the threat of significant ice features is nearly year-around and there is a significant probability that the ice is either too large to be managed or escapes active ice management. For example, the casing/cementing of a wellbore may take several days and it is unacceptable to disconnect the riser during such operations. Therefore, significant risks are associated with drilling in icy regions. In such locations an alternative strategy is needed to enable drilling and related operations without increased occurrence of emergency disconnect.

Thus, there is a need for improvement in this field.

SUMMARY OF THE INVENTION

The present invention provides and system and method to avoid obstacles during hydrocarbon operations.

One embodiment of the present disclosure is an offshore hydrocarbon operations system comprising: a vessel; a conduit connected to the vessel with a first rotatable apparatus, the first rotatable apparatus is constructed and arranged to permit the vessel to rotate with respect to the conduit; a subsea equipment secured to a seafloor; and a second rotatable apparatus connecting the conduit to the subsea equipment, the second rotatable apparatus is constructed and arranged to permit the conduit to rotate with respect to the subsea equipment.

The foregoing has broadly outlined the features of one embodiment of the present disclosure in order that the detailed description that follows may be better understood. Additional features and embodiments will also be described herein.

BRIEF DESCRIPTION OF THE DRAWINGS

The present invention and its advantages will be better understood by referring to the following detailed description and the attached drawings.

Figure 1:
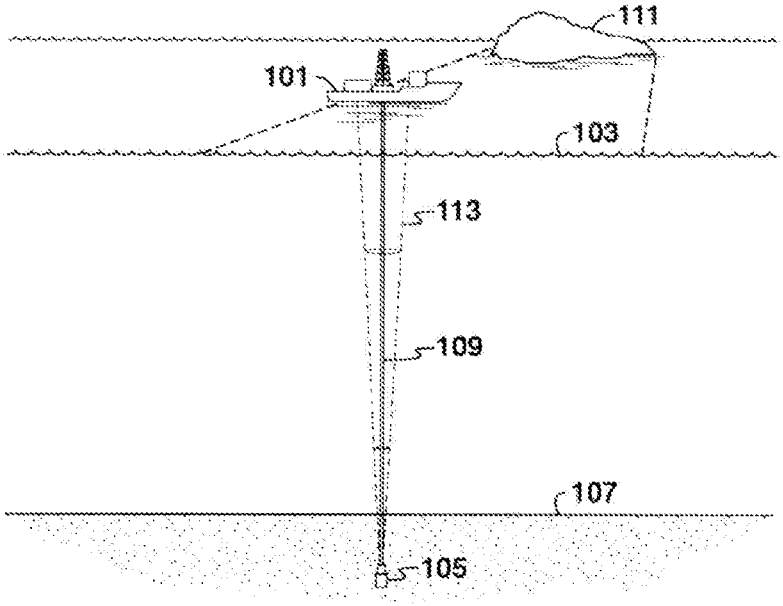
FIG. 1 Prior Art
FIG. 1 is a schematic side view of an offshore drilling system as known in the prior art.

It should be noted that the figures are merely examples of several embodiments of the present invention and no limitations on the scope of the present invention are intended thereby. Further, the figures are generally not drawn to scale, but are drafted for purposes of convenience and clarity in illustrating various aspects of certain embodiments of the invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
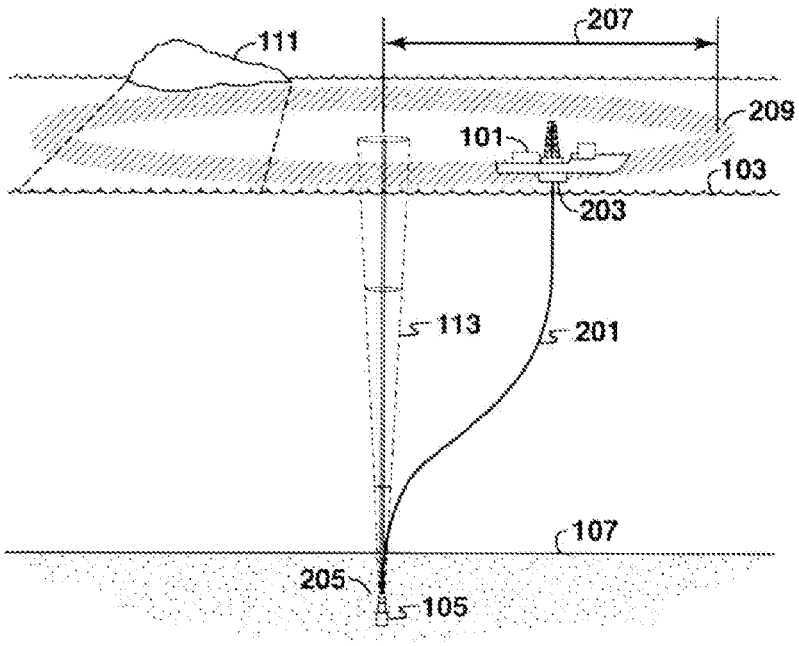
FIG. 2 is a schematic side view of an offshore drilling system according to one embodiment of the present disclosure.

An offshore drilling system according to one embodiment of the present disclosure is depicted in FIG. 2. The offshore drilling system depicted in FIG. 2 contains many of the components depicted in FIG. 1. Vessel 101 floats in the water 103. Wellhead 105 is positioned on the seafloor 107. A flexible riser 201 connects the wellhead 105 to the vessel 101 and passes drilling materials such as, but not limited to, drilling fluid, drill bit and string, casings, and cement. As appreciated by those skilled in the art, wellhead 105 may be equipped with additional hardware, such as, but not limited to, a blowout preventer or a lower marine riser package.

Unlike the system depicted in FIG. 1, the FIG. 2 system includes a top swivel 203 connecting the vessel 101 and the riser 201. A base swivel 205 is also provided which connects the riser 201 to the wellhead 105. In other embodiments, the base swivel 205 may directly attach to other wellhead-related equipment, such as a blowout preventer or lower marine riser package to name a couple examples. As depicted, vessel 101 is laterally offset from the wellhead. The lateral offset is represented by reference numeral 207. Lateral offset 207 is greater than horizontal tolerances 113 typically associated with vertical risers.

Though not depicted, at least one propulsion device may be attached to vessel 101. Suitable propulsion devices are known to those skilled in the art and may be any type of propeller, thruster, propulsor, or water jet, to name a few non-limiting examples. The propulsion devices may be operated using known techniques for station-keeping of the vessel 101 while in body of water 103.

The inclusion of top swivel 203 and base swivel 205 allow the riser to rotate with respect to vessel 101 and wellhead 105, respectively. In the depicted embodiment, the top swivel 203 and base swivel 205 enable the laterally offset vessel 101 to travel along a circular path 209 centered on wellhead 105. The operational range of the vessel 101 is essentially transformed from a point with an offset tolerance (see 113 of FIG. 1) to a circle with an offset tolerance (path 209). As previously discussed, while drilling in offshore arctic locations, current systems often require a vessel to disconnect from the wellhead 105 due to intrusions of unmanageable ice 111 flowing into the watch circle, or area surrounding the vessel 101. In the depicted embodiment, the relatively large lateral offset 207 and the ability of vessel 101 to move along circular path 209 allows the vessel 101 to avoid or mitigate the impending ice 111 without disconnecting the riser 201 from the wellhead 205.

As appreciated by those skilled in the art, the drill string is in constant rotation and under high tensile loads while in the riser 201. Therefore, the curvature of the riser should be accounted for and limited to meet system design objectives. In one embodiment, the curvature of the riser 201 is kept to a maximum curvature of 3°/100 ft of riser or a radius of curvature of approximately 580 m. Such a curvature allows for an approximate 500 m lateral offset in 1000 m water. Other curvatures may be implemented based upon a variety of considerations, such as, but not limited to, design objectives, water depth, riser strength, etc. In addition to curvature, the riser angle from horizontal may be also limited in order to enable certain operations (such as, but not limited to, ball-drop activated equipment) or to limit fatigue or wear to the riser or drill string.

Figure 3:
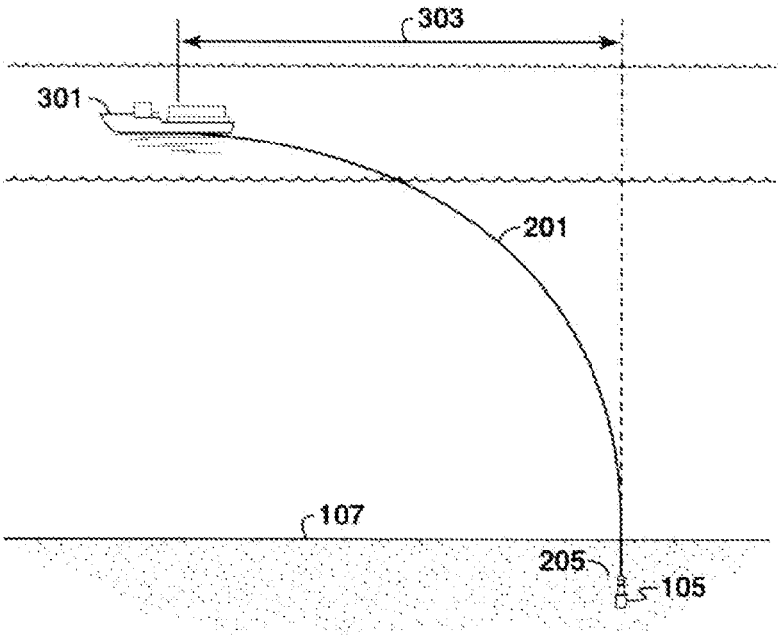
FIG. 3 is a schematic side view of an offshore drilling system according to another embodiment of the present disclosure.
Figure 4:
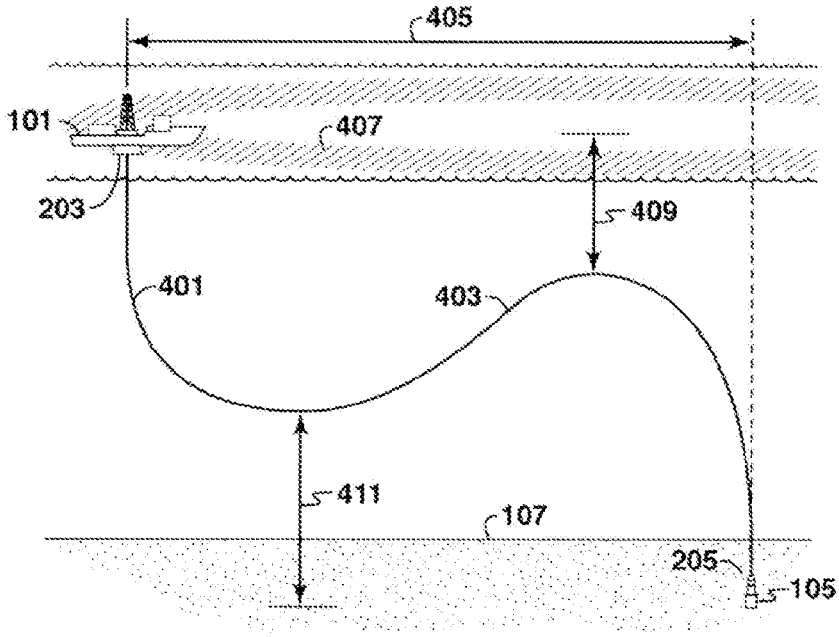
FIG. 4 is a schematic side view of an offshore drilling system according to a further embodiment of the present disclosure.

FIGS. 3 and 4 are schematic side views of offshore drilling systems according to other embodiments of the present disclosure. Though the configurations depicted in FIGS. 3 and 4 may not be practical to perform certain marine or drilling activities, these configurations would enable greater lateral offsets in shallower water as compared to the configuration depicted in FIG. 2.

The system depicted in FIG. 3 includes a vessel 301 with a horizontal drill derrick. In other embodiments, the drilling derrick may be slanted to some degree with respect to horizontal. Embodiments having a vessel 301 with a horizontal or slanted derrick provide a greater lateral offset 303 with a lesser riser 201 bend. In one embodiment, a 500 m lateral offset can be achieved in a water depth of 600 m. Embodiments of the present disclosure utilizing a horizontal or slanted derrick may utilize an axisymmetric vessel such that the vessel can easily rotate the derrick to align with the wellhead 105 as the vessel travels along its circular path. In such an embodiment, a top swivel may or may not be included. As with the FIG. 2 embodiment, a base swivel 205 is provided to enable a rotatable connection between riser 201 and wellhead 105.

The system depicted in FIG. 4 includes a vessel 101 with a vertical drill derrick. However, the riser 401 of this embodiment has at least one negative riser slope section 403. The inclusion of negative riser slope sections allows for a large lateral offset 405 in relatively shallow water while maintaining the utilization of a vertical drilling derrick. Naturally, the large lateral offset 405 enables a larger circular path 407 for the vessel 101 to travel in order to avoid impending ice or other hazardous conditions. In one embodiment, a 2000 m lateral offset can be achieved in a water depth of 800 m.

In the embodiment depicted in FIG. 4, riser 401 is designed to provide sufficient waterline clearance 409 such that the riser 401 avoids damage from objects floating in the water, such as, but not limited to, ice or other vessels. Riser 401 is further designed to provide sufficient seafloor clearance 411 such that the riser 401 avoids damage from object residing the seafloor 101 or significant seafloor features.

Figure 5:
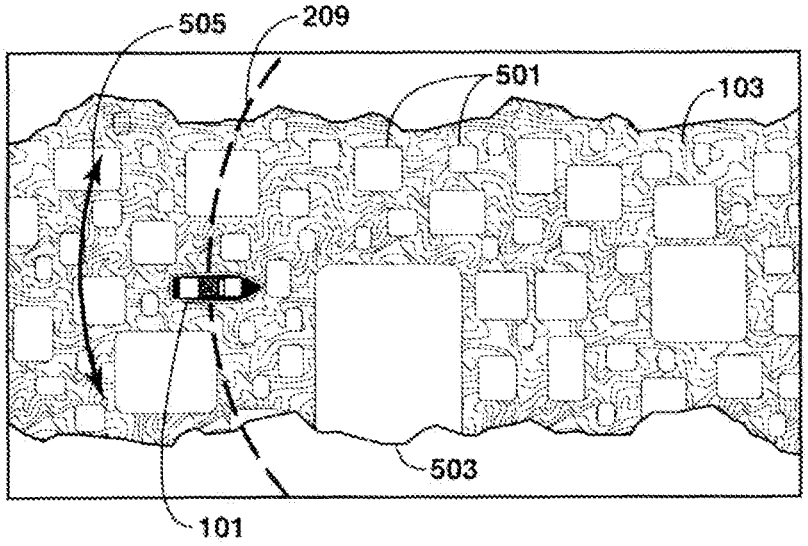
FIG. 5 is a top plan view demonstrating the ability of the vessel to avoid ice according to one embodiment of the present disclosure.

As will be appreciated by those skilled in the art considering the present disclosure, the top swivel 203 enables the vessel 101 to weathervane towards the prevailing wind, wave, current and/or ice forces. As discussed herein, base swivel 205 enables the vessel 101 to rotationally traverse around a wellhead 105 to avoid dangerous surface objects such as icebergs. One embodiment of such a capability is depicted in FIG. 5. An illustrated watch area around vessel 101 includes small ice 501 and large ice 503. As previously discussed, vessel 101 is capable of moving in a semi-rigid circular path 209. Based on area conditions, such as impending large ice 503, the vessel 101 can be moved (as depicted with arrow 505) in order to avoid the dangerous ice 503.

Figure 6:
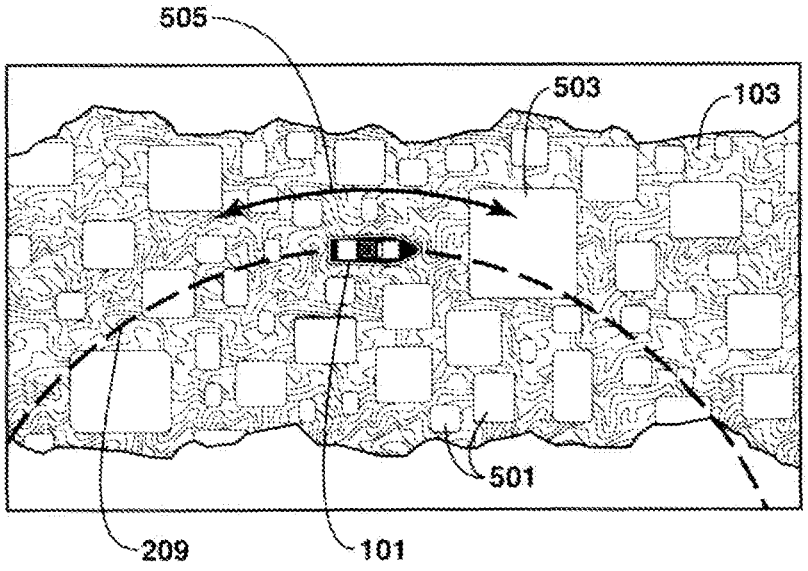
FIG. 6 is a top plan view demonstrating the ability of the vessel to build momentum in order to push throw ice floes according to one embodiment of the present disclosure.

The ability to move in a circular path 209 on the water surface also allows the vessel 101 to gain momentum to push through more competent ice floes. Such a scenario is depicted in FIG. 6. In the illustrated embodiment, vessel 101 is moved (as depicted by arrow 505) toward large ice 503 in order to build momentum and punch through the ice 503. Punching through ice floes is not an option in current systems as the vessel is effectively restricted to point, thereby eliminating the possibility of generating vessel velocity and momentum.

Figure 7:
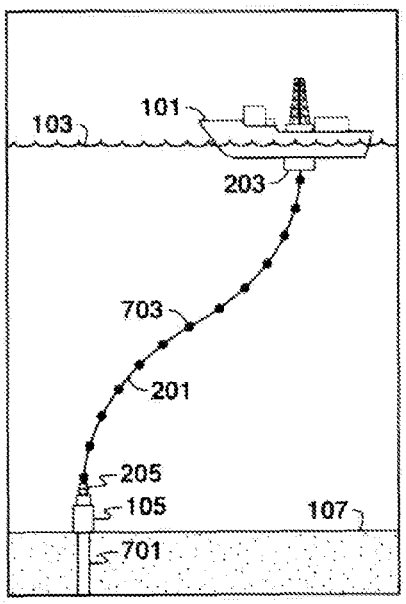
FIG. 7 is a schematic side view of an offshore drilling system according to one embodiment of the present disclosure.

FIG. 7 is a schematic side view of a further embodiment of the present disclosure. For clarity, elements common with the systems depicted in FIGS. 1 and 2 have been repeated. FIG. 7 depicts wellhead 105 positioned adjacent to the upper end of a wellbore 701. The depicted embodiment further comprises a plurality of variable buoys 703 provided along riser 201. Using techniques known to those skilled in the art, downward curvature can be achieved in riser sections with negative net buoyancy and upward curvature can be achieved with net positive buoyancy.

In embodiments of the present disclosure, the vessel 101 and subsurface equipment may be the same or similar to current technology with reinforcement as necessary for additional forces. Riser 201 may have a construction and design as known in the current art. In some embodiments, riser 201 forms a gradual "S" curve in order to allow fluids and equipment to pass and so that the connection to both the vessel 101 and subsea equipment (for example, wellhead 105) is continuous. The curvature and stability of the riser 201 shape may be controlled through a variety of techniques. In one embodiment, curvature and stability are provided by adding weights or variable buoys 703 along the length of the riser 201. In other embodiments, the axial force applied to the riser 201 is changed or altered.

Figure 8:
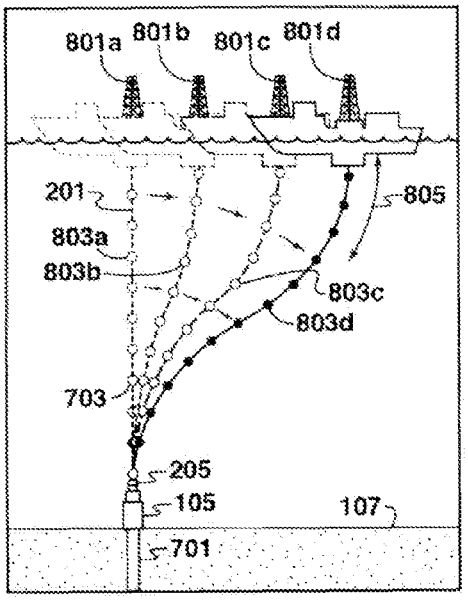
FIG. 8 illustrates a vessel being laterally offset from a wellhead according to one embodiment of the present disclosure.

FIG. 8 illustrates a vessel being laterally offset from a wellhead according to one embodiment of the present disclosure. In the depicted embodiment, a dynamically positioned drill vessel 101 arrives on location over the well location. Installation of the basic well structure would proceed according to known techniques. In some embodiments, the installation process would include installing the initial casing strings, a BOP and wellhead 105. In some embodiments of the present disclosure, a base swivel 205 is also installed on the wellhead 105, or other riser terminus selected for system design. As appreciated by those skilled in the art, the riser terminus may be a BOP, PLET or other subsea connection.

According to one embodiment of the present disclosure, once the well structure installation process is completed, the riser 201 would be installed section by section. In the depicted embodiment, added weights or buoys 703 are also provided to achieve the desired riser geometry. Other embodiments may not include the weights or buoys on the riser. Once riser 201 is set vertically, additional sections of riser would be added as the vessel moves to the laterally offset location. In FIG. 8, the vessel and riser are shown at different positions. The initial vessel and riser positions are identified by reference numerals 801*a* and 803*a*, respectively. As riser sections are added, the vessel becomes more laterally offset from the wellhead 105 and progresses through vessel positions 801*b*, 801*c* and 801*d*. Similarly, the riser progresses through riser positions 803*b*, 803*c* and 803*d*. The total riser section added between riser position 803*a* and 803*d* is depicted by arrow 805.

In the depicted embodiment, as the vessel moves from position 801*a* to 801*d*, the riser 201 assumes a gently "S" curve with the aid of buoys 703 positioned along the riser 201. The differential buoys 703 are provided so that riser bend is more continuous and the reaction forces and curvature at the ends of riser are acceptable. Naturally, the vessel 101 not move back to a position directly over the wellhead 105, without removing the additional riser sections, because doing so would potentially buckle riser, damage connections, or, at a minimum, increasing the stress and fatigue at critical locations.

Figure 9:
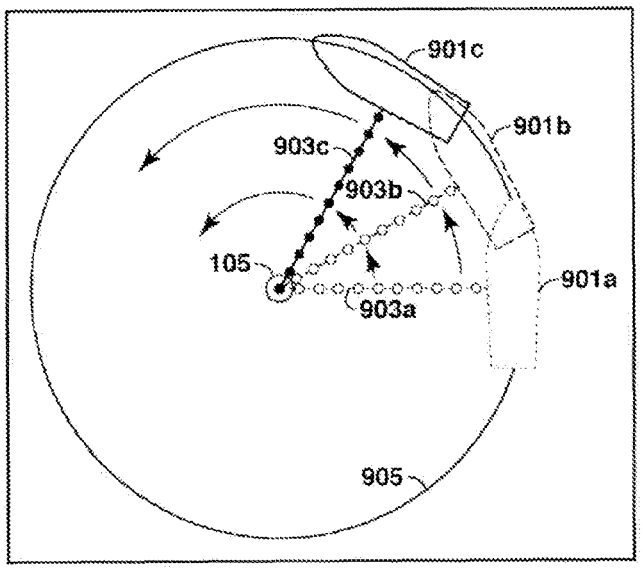
FIG. 9 illustrates the circular motion of a vessel which is laterally offset from a wellhead according to one embodiment of the present disclosure.

As discussed herein, embodiments of the present disclosure allow the orientation of a surface vessel and the attached riser to be changed with respect to the seafloor riser attachment point. In other words, the vessel and riser do not maintain the same absolute (GPS) location; however, the vessel and riser do maintain the same distance and angle (within some tolerance) from the fixed subsea equipment resulting in rigid body rotation around the seafloor equipment. FIG. 9 illustrates the circular motion of a vessel which is laterally offset from a wellhead according to one embodiment of the present disclosure. Similar to FIG. 8, FIG. 9 depicts the vessel and riser at different positions. The initial vessel and riser positions are identified by reference numerals 901*a* and 903*a*, respectively. As the vessel rotates about wellhead 105, the vessel becomes moves along a circular path 905 and progresses through vessel positions 901*b* and 901*c*. Similarly, the riser progresses through riser positions 903*b* and 903*c*.

As discussed herein, embodiments of the present disclosure describe that the vessel may be configured to station keep and move along a circular path via propulsion devices. The propulsion devices may be manually controlled and/or automatically operated based on environmental and water conditions, such as, but not limited to, the detection of upcoming obstacles. While the present disclosure describes the vessel in the context of a drillship, the vessel may be also be a floating production, storage and offloading vessel (FPSO), a floating production of liquefied natural gas vessel (FLNG), a floating storage and regasification unit for LNG (FSRU), a gas-to-liquids floating production, storage and offloading vessel (GTL), and a gas-to-chemicals floating production, storage and offloading vessel (GTC) to name a few non-limiting examples. The utilization of the principles described herein with vessels other than a drillship may require different components. For example, the use of a FPSO vessel may require a top and a bottom turret to replace the top and bottom swivels and multiple flowlines may be placed between the wellhead and the vessel instead of a single riser. In such an embodiment, the water depth and flowline curvature restrictions would not be as limited as the requirements necessary to limit drillstring fatigue.

The following lettered paragraphs represent non-exclusive ways of describing embodiments of the present disclosure.

A. An offshore hydrocarbon operations system comprising: a vessel; a conduit connected to the vessel with a first rotatable apparatus, the first rotatable apparatus is constructed and arranged to permit the vessel to rotate with respect to the conduit; a subsea equipment secured to a seafloor; and a second rotatable apparatus connecting the conduit to the subsea equipment, the second rotatable apparatus is constructed and arranged to permit the conduit to rotate with respect to the subsea equipment.

B. The system of paragraph A, wherein the vessel is laterally offset from the riser equipment.

C. The system of paragraph B, wherein the offset is greater than 500 meters.

D. The system of any preceding paragraph wherein the conduit is a drilling riser, the first rotatable apparatus is a top swivel, and the second rotatable apparatus is a base swivel.

E. The system of paragraph D further comprising at least one buoy positioned along the riser.

F. The system of paragraph D or E, wherein the vessel is equipped with a vertical drilling derrick.

G. The system of paragraph D or E, wherein the vessel is equipped with a horizontal drilling derrick.

H. The system of paragraph D, E, F or G, wherein the riser has at least one negative riser slope section.

I. The system of any preceding paragraph, wherein the subsea equipment is a wellhead.

J. The system of any preceding paragraph, wherein the vessel is selected from the group consisting of a floating production, storage and offloading vessel (FPSO), a floating production of liquefied natural gas vessel (FLNG), a floating storage and regasification unit for LNG (FSRU), a gas-to-liquids floating production, storage and offloading vessel (GTL), and a gas-to-chemicals floating production, storage and offloading vessel (GTC).

K. The system of any preceding paragraph, wherein the first rotatable apparatus is a first turret, and the second rotatable apparatus is a second turret.

AA. A method for positioning a drilling vessel comprising: providing an offshore drilling system comprising: a riser connected to the vessel with a top swivel, a subsea equipment secured to a seafloor, and a base swivel connecting the riser to the subsea equipment, the base swivel is constructed and arranged to permit the riser to rotate with respect to the subsea equipment; laterally offsetting the vessel from the subsea equipment by adding riser sections.

BB. The method of paragraph AA further comprising adding at least one buoy along the riser.

CC. The method of paragraph AA or BB, wherein the vessel is laterally offset more than 500 meters from the subsea equipment.

DD. A method of producing hydrocarbons from a subsea wellhead secured to the seafloor, the method comprising: positioning a vessel in a body of water, the vessel is equipped with a hydrocarbon operations system comprising: a conduit connected to the vessel with a first rotatable apparatus, the first rotatable apparatus is constructed and arranged to permit the vessel to rotate with respect to the conduit, and a second rotatable apparatus connecting the conduit to the wellhead, the second rotatable apparatus is constructed and arranged to permit the conduit to rotate with respect to the wellhead; laterally offsetting the vessel from the wellhead; receiving the hydrocarbons into the vessel; and moving the vessel along a circular path centered at the wellhead.

EE. The method of paragraph DD, wherein the vessel is laterally offset more than 500 meters from the wellhead.

FF. The method of any preceding paragraph, wherein the vessel is selected from the group consisting of a floating production, storage and offloading vessel (FPSO), a floating production of liquefied natural gas vessel (FLNG), a floating storage and regasification unit for LNG (FSRU), a gas-to-liquids floating production, storage and offloading vessel (GTL), and a gas-to-chemicals floating production, storage and offloading vessel (GTC).

GG. The method of any preceding paragraph, wherein the first rotatable apparatus is a first turret, and the second rotatable apparatus is a second turret.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. An offshore hydrocarbon operations system comprising:

a vessel;

a conduit connected to the vessel with a first rotatable apparatus, the first rotatable apparatus is constructed and arranged to permit the vessel to rotate with respect to the conduit;

a subsea equipment positioned on a seafloor; and a second rotatable apparatus connecting the conduit to the subsea equipment, the second rotatable apparatus is constructed and arranged to permit the conduit to rotate with respect to the subsea equipment, wherein the first rotatable apparatus and the second rotatable apparatus are arranged to enable the vessel to be laterally offset and travel along a circular path centered on the subsea equipment, the circular path being laterally offset a distance from the subsea equipment allowing the vessel to generate velocity or momentum to push through an ice floe.

2. The system of claim 1, wherein the distance is greater than 500 meters.

3. The system of claim 1, wherein the conduit is a drilling riser, the first rotatable apparatus is a top swivel, and the second rotatable apparatus is a base swivel.

4. The system of claim 3 further comprising at least one buoy positioned along the riser.

5. The system of claim 3, wherein the vessel is equipped with a vertical drilling derrick.

6. The system of claim 3, wherein the vessel is equipped with a horizontal drilling derrick.

7. The system of claim 3, wherein the riser has at least one negative riser slope section.

8. The system of claim 1, wherein the subsea equipment is a wellhead.

9. The system of claim 1, wherein the vessel is selected from the group consisting of a floating production, storage and offloading vessel (FPSO), a floating production of liquefied natural gas vessel (FLNG), a floating storage and regasification unit for LNG (FSRU), a gas-to-liquids floating production, storage and offloading vessel (GTL), and a gas-to-chemicals floating production, storage and offloading vessel (GTC).

10. The system of claim 1, wherein the first rotatable apparatus is a first turret, and the second rotatable apparatus is a second turret.

11. A method for positioning a drilling vessel comprising:

providing an offshore drilling system comprising:

a riser connected to the vessel with a top swivel, the top swivel constructed and arranged to permit the vessel to rotate with respect to the riser, a subsea equipment positioned on a seafloor, and a base swivel connecting the riser to the subsea equipment, the base swivel is constructed and arranged to permit the riser to rotate with respect to the subsea equipment, wherein the top swivel and the base swivel are arranged to enable the vessel to be laterally offset and travel along a circular path centered on the subsea equipment;

laterally offsetting the vessel from the subsea equipment by adding riser sections; and moving the vessel along a circular path centered at the subsea equipment, the circular path being laterally offset a distance from the subsea equipment allowing the vessel to generate velocity or momentum to push through an ice floe.

12. The method of claim 11 further comprising adding at least one buoy along the riser.

13. The method of claim 11, wherein the distance is more than 500 meters from the subsea equipment.

14. A method of producing hydrocarbons from a subsea wellhead secured to a seafloor, the method comprising:

positioning a vessel in a body of water, the vessel is equipped with a hydrocarbon operations system comprising: a conduit connected to the vessel with a first rotatable apparatus, the first rotatable apparatus is constructed and arranged to permit the vessel to rotate with respect to the conduit, and a second rotatable apparatus connecting the conduit to the wellhead, the second rotatable apparatus is constructed and arranged to permit the conduit to rotate with respect to the wellhead;

laterally offsetting the vessel from the wellhead;

receiving the hydrocarbons into the vessel; and moving the vessel along a circular path centered at the wellhead, the circular path being laterally offset a distance from the wellhead allowing the vessel to generate velocity or momentum to push through an ice floe.

15. The method of claim 14, wherein the distance is more than 500 meters from the wellhead.

16. The method of claim 14, wherein the vessel is selected from the group consisting of a floating production, storage and offloading vessel (FPSO), a floating production of liquefied natural gas vessel (FLNG), a floating storage and regasification unit for LNG (FSRU), a gas-to-liquids floating production, storage and offloading vessel (GTL), and a gas-to-chemicals floating production, storage and offloading vessel (GTC).

17. The method of claim 14, wherein the first rotatable apparatus is a first turret, and the second rotatable apparatus is a second turret.

* * * * *